United States Patent [19]

Mekelburg

[11] 4,263,693

[45] Apr. 28, 1981

[54] VACUUM CLEANER HEAD

[76] Inventor: Clayton G. Mekelburg, P.O. Box 4419, Louisville, Ky. 40204

[21] Appl. No.: 48,847

[22] Filed: Jun. 15, 1979

[51] Int. Cl.[3] ..... A47L 9/08

[52] U.S. Cl. ..... 15/322; 15/345; 15/354; 15/418; 15/421

[58] Field of Search ..... 15/321, 322, 345, 346, 15/354, 421, 418

[56] References Cited

U.S. PATENT DOCUMENTS

| | | | |
|---|---|---|---|
| 1,060,191 | 4/1913 | Kent | 15/421 |
| 2,275,357 | 3/1942 | Gaines | 15/421 X |
| 3,268,942 | 8/1966 | Rossnan | 15/346 |
| 3,678,534 | 7/1972 | Hilbig | 15/345 |
| 3,705,437 | 12/1972 | Rukavina et al. | 15/322 X |
| 4,037,290 | 7/1977 | Rose et al. | 15/345 |

FOREIGN PATENT DOCUMENTS

| | | | |
|---|---|---|---|
| 2234858 | 1/1974 | Fed. Rep. of Germany | 15/345 |

*Primary Examiner*—Christopher K. Moore
*Attorney, Agent, or Firm*—Michael J. Colitz, Jr.

[57] ABSTRACT

A vacuum cleaner head especially useful for removing loose and partially embedded gravel and similar particulates from roofs and other surfaces, having a nozzle supported slightly out of contact with the surface being cleaned, by a peripheral glide shoe, shielded jets for introducing high velocity fluid into the nozzle, adjustable vents for introducing ambient air into the nozzle, and adjustments for the nozzle height and jet direction and height.

11 Claims, 3 Drawing Figures

VACUUM CLEANER HEAD

BACKGROUND OF THE INVENTION

The present invention relates to a vacuum cleaner head which is especially useful for removing gravel and similar particulates from roofs and other surfaces. The invention will be described with respect to that particular application, although those skilled in the art will recognize the invention's applicability in other environments.

One of the most common types of flat roof construction for industrial, institutional and commercial buildings consists of a waterproof membrane, formed of alternate layers of a bitumen-saturated felt with layers of a bituminous sealant, and a loose covering of particulate material applied to the uppermost layer forming the waterproof membrane. The particulate material may, for example, be pea gravel, which ranges in size from $\frac{1}{4}$ inch to $\frac{3}{8}$ inch, or larger rock ranging from $\frac{1}{2}$ inch to $\frac{5}{8}$ inch.

From time to time, such roofs must be inspected, and where warranted, repaired. In order to accomplish these activities, the particulates, applied when the roof was constructed, together with dirt, grit and other materials which have accumulated with the passage of time must first be removed. One prior art system for removing such particulates, dirt and grit is described in my U.S. Pat. No. 3,955,236. This system involves vacuuming loose material off the roof, collecting and separating large particles from dust, filtering dust from the air and returning dust-free air to the atmosphere. The vacuum cleaner head used with this equipment, however, is of more or less conventional design.

While the method and equipment described in U.S. Pat. No. 3,955,236 is very effective in removing loose particulates, and substantially reduces the problem of dust generation described in the patent, it is not designed to remove partially embedded particulates and baked-on accumulations of dirt, grit, pollutants and the like.

The vacuum cleaner head of the present invention can be used to enhance the effectiveness of the system described in U.S. Pat. No. 3,955,236 by combining high velocity fluid jets, preferably water jets, with vacuum to accomplish the removal of partially embedded and baked-on particulates.

Others have recognized the advantage of combining vacuum and high velocity fluid jets to remove particulate matter from containers. See, for example, U.S. Pat. No. 3,959,845 which uses vacuum and high pressure fluid to remove particles from within mining cars. Also of interest are the teachings of U.S. Pat. No. 3,808,631 which disclose a shovel-like device for removing sludge from the surface of a liquid or from a floor such as a deck of a tanker.

The vacuum cleaner head disclosed in U.S. Pat. No. 3,959,845 is designed to be manipulated by a hydraulically actuated "back-hoe", and clearly cannot be hand-held nor slid along the surface to be cleaned.

The vacuum cleaner head illustrated in U.S. Pat. No. 3,808,631 while slidable along the surface to be cleaned, is clearly designed for the removal of a semi-fluid material, such as sludge. Because of the sharp, digging, leading edge of the shovel, it would not function well in the environment of a roof covered with gravel.

Other references of more general interest showing the state of the art include U.S. Pat. Nos. 4,137,600, 4,073,030, 3,963,515, 3,345,672, 2,916,761, and 2,646,889; British Pat. Nos. 1,288,763, 1,038,950 and 892,658; and French Pat. No. 2,264,510.

BRIEF SUMMARY OF THE INVENTION

In accordance with one aspect of the present invention, there is provided a hand-held, slidable vacuum cleaner head useful for removing loose and partially embedded gravel or similar particulates from roofs and other surfaces, comprising an elongated vacuum nozzle having a top, sides and an open bottom defining a vacuum chamber, means providing communication between the vacuum chamber and a source of vacuum, support means for the nozzle comprising means disposed peripherally of and circumscribing the open bottom of the nozzle, means for adjusting the height of the nozzle with respect to the support means, means for injecting fluid under pressure into the vacuum chamber comprising a plurality of fluid conduits spaced longitudinally of the nozzle and extending through the top of the nozzle into the vacuum chamber, each conduit terminating in a fluid jet, means for moving the fluid conduits and their respective fluid jets toward and away from the open bottom of the nozzle, and means for connecting the fluid conduit with a source of fluid under pressure.

In accordance with a further aspect of the present invention, the vacuum cleaner head is provided with adjustable means establishing communication between the vacuum chamber and ambient atmosphere.

When the height of the vacuum nozzle with respect to its support means, the height of the fluid jets with respect to the surface being cleaned, and the means providing communication between the vacuum chamber and ambient atmosphere, are all properly adjusted, the vacuum cleaner head of the present invention is capable of lifting loose gravel and other particulates, and freeing and lifting partially embedded gravel and other adhering particulates including baked-on pollutants, and removing these materials together with dirt, grit and other accumulated fines from the surface of the roof, and removing most of the fluid material jetted onto the surface of the roof, while leaving the immediate environment of the activity virtually undisturbed. Thus, the operation provides instant recovery of all loose and loosened materials and jetted fluid, introduces no dust into the atmosphere and virtually no water vapor, and leaves the roof surface clear of all but deeply embedded gravel and other particulate material, clean to the touch, and slightly damp.

It is therefore an object of the invention to provide an improvement in a vacuum cleaner head which is useful for removing gravel and similar particulates from roofs and other surfaces.

A further object of the invention is to provide a hand-held, slidable vacuum cleaner head which is capable of removing gravel, dirt, grit and other particulates from a surface, while leaving the surface clean to the touch.

A still further object of the invention is to provide an improved vacuum cleaner head which is capable of removing loose and partially embedded gravel, baked-on pollutants and similar particulates from roofs and other surfaces without disturbing the proximate environment of this activity.

Yet another object of the invention is to provide a hand-held, slidable vacuum cleaner head which is provided with adjustments for the height of the vacuum nozzle, the height of fluid jets, and for the introduction of ambient air, to provide a balanced system under various operating conditions.

These and other objects and advantages of the invention will become apparent from the following detailed discussion thereof, which includes the best mode presently contemplated for practicing the invention, when taken in conjunction with the accompanying drawings, in which.

DETAILED DESCRIPTION OF THE INVENTION

Figure 1:
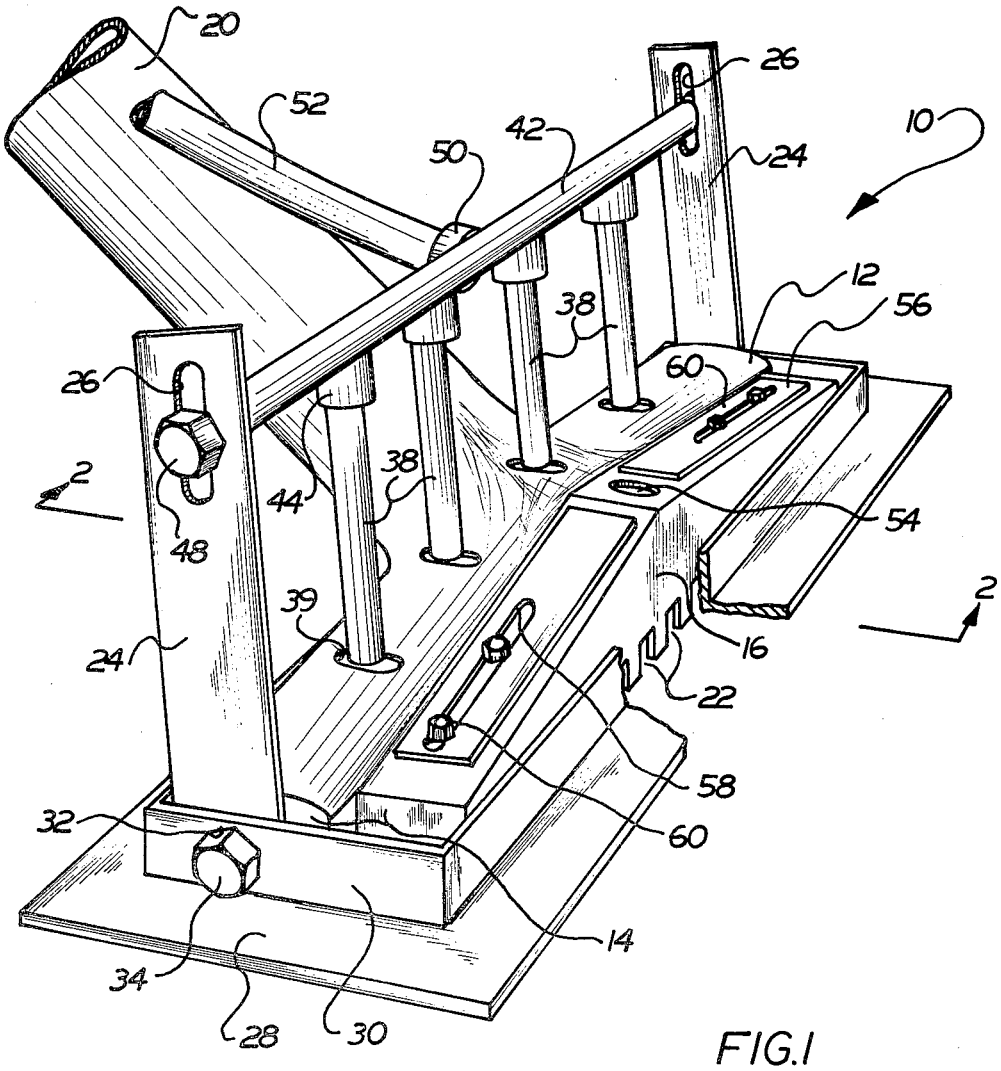
FIG. 1 is a schematic perspective view, with parts cut away, showing a vacuum cleaner head in accordance with the present invention.
Figure 3:
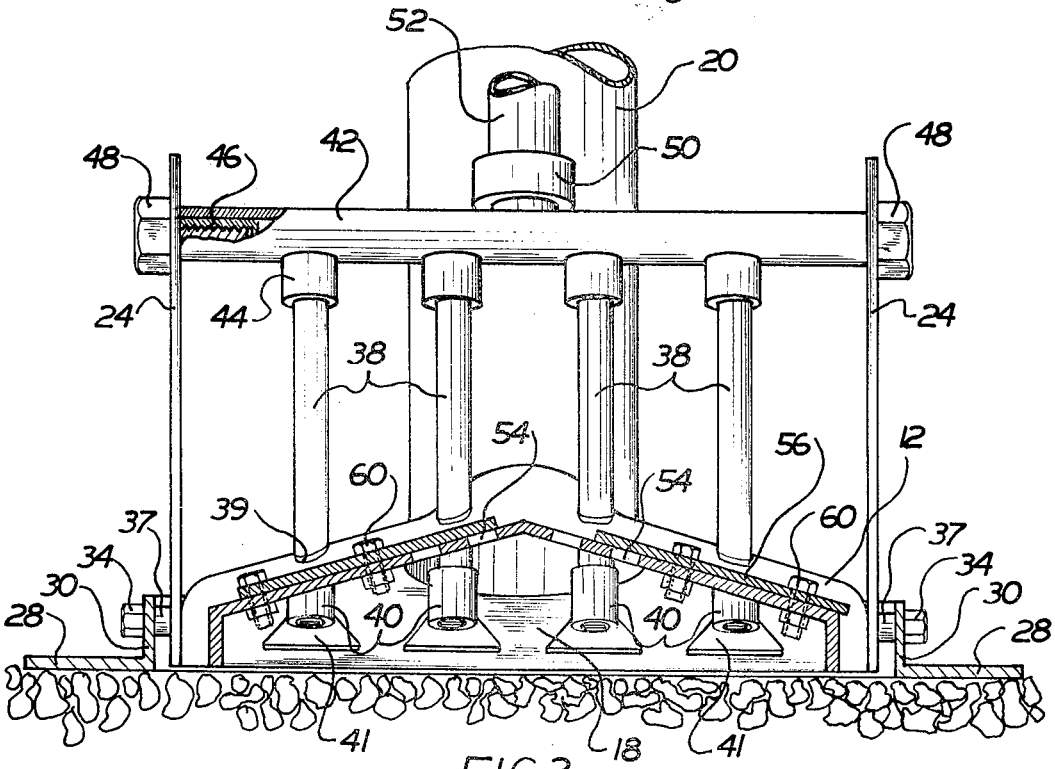
FIG. 3 is a schematic section view taken generally along the line 3—3 of FIG. 2.

Referring to the drawings, and particularly to FIG. 1, it will be seen that the vacuum cleaner head of the present invention comprises elongated vacuum nozzle, designated generally as 10, having top 12, short sides 14, long sides 16, and an open bottom, forming vacuum chamber 18 (FIG. 3).

Formed integrally with elongated vacuum nozzle 10 is a vacuum tube 20 connected to a source of vacuum, not illustrated.

As best seen in FIG. 1, the lower edge of side 16 illustrated, is provided with a plurality of fixed openings 22, the function of which will be discussed presently.

Sides 14 of elongated vacuum nozzle 10 have affixed to them generally upright arms 24, each of which is provided at or near its upper end with slot 26.

Figure 2:
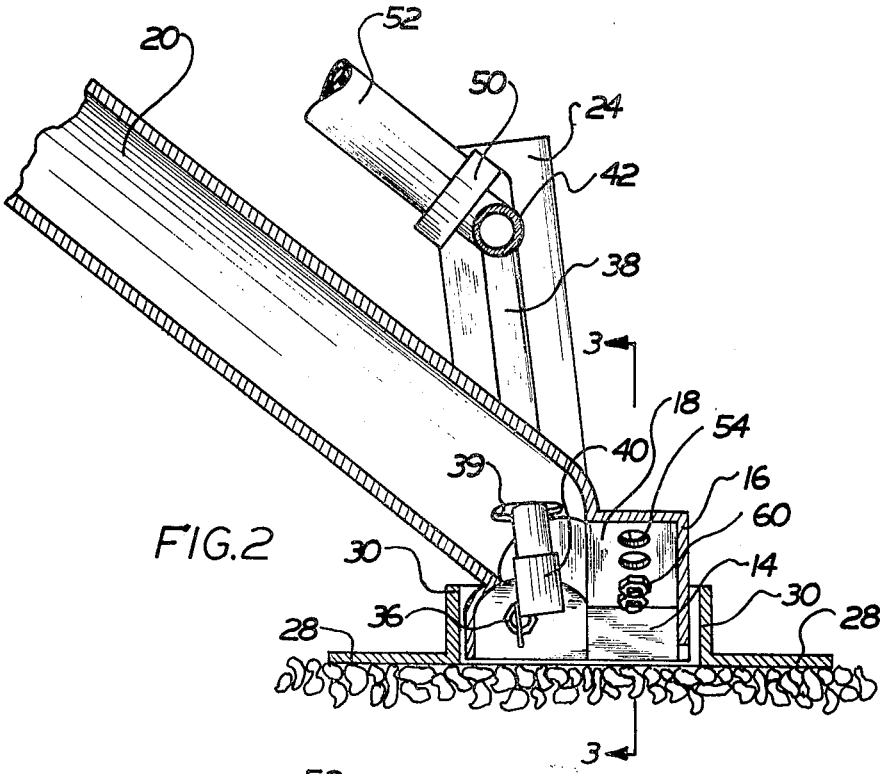
FIG. 2 is a schematic section view taken generally along the line 2—2 of FIG. 1.

The vacuum cleaner head of the present invention is further provided with support means for vacuum nozzle 10, which in the embodiment illustrated takes the form of planar member or guide shoe 28 disposed peripherally of and circumscribing the open bottom of vacuum nozzle 10. As best seen in FIGS. 2 and 3, the opening in glide shoe 28 is slightly larger in each dimension than the open bottom of vacuum nozzle 10. This permits movement of the nozzle with respect to the glide shoe.

Disposed along the inner periphery of glide shoe 28 is upstanding bracket 30, the ends of which are in close proximity to sides 14 of vacuum nozzle 10, are provided with slotted apertures 32. As best seen in FIG. 3, a bolt assembly comprising bolt 34 passes through the slotted aperture 32 in upstanding bracket 30, through arm 24, and through an opening in side 14 of vacuum nozzle 10, and is secured in place by nut 36. Washer 37 (FIG. 3) is interposed between arm 24 and upstanding bracket 30 to maintain proper alignment of the parts.

The vacuum cleaner head further comprises means for injecting fluid, preferably a liquid such as water, under pressure into the vacuum chamber which means, in the embodiment illustrated, takes the form of a plurality of fluid conduits 38 spaced longitudinally of and extending through elongated openings 39 in top 12 of elongated vacuum nozzle 10, into vacuum chamber 18, each such conduit terminating in a fluid jet 40.

Attached to the lower end of each jet 40 is shield 41 which serves to protect the spray pattern issuing from the jet against distortion due to the force of air passing into the nozzle through openings 22 and exiting through vacuum tube 20.

Further provided are conduit support means for moving fluid conduits 38 and their corresponding fluid jets 40 toward and away from the open bottom of vacuum nozzle 10, which means, in the embodiment illustrated, takes the form of fluid conduit 42 secured by fluid tight couplings 44 to each of fluid conduits 38, threaded plugs 46 disposed in the ends of fluid conduit 42, and bolts 48 passing through slots 26 in arms 24, into threaded engagement with plugs 46.

Fluid conduit 42 is connected by fluid tight coupling 50, to pipe 52 and thence to a source of pressurized fluid (not shown).

Vacuum nozzle 10 further comprises adjustable means providing communication between vacuum chamber 18 and ambient atmosphere, which adjustable means, in the embodiment illustrated, takes the form of apertures 54 disposed in top 12 of vacuum nozzle 10, imperforate means, exemplified by slidable plates 56, having slotted openings 58, and bolt assembly 60, for fixedly sliding plates 56 from a first position where apertures 54 are substantially covered, to a second position where said apertures are substantially exposed.

As best illustrated in FIG. 3, the relative adjustment between vacuum nozzle 10 and glide shoe 28 is preferably such that the bottom surface of the glide shoe is in a slightly lower horizontal plane than is the bottom of the vacuum nozzle. In this way, contact between the vacuum cleaner head and the surface to be cleaned will be limited to the bottom surface of glide shoe 28. This keeps friction at a minimum and permits the hand-held nozzle to slide easily over the surface. By contrast, if the lower edge of the vacuum nozzle was in the same horizontal plane or a lower horizontal plane than the bottom surface of glide plate 28, the vacuum cleaner head would have a tendency to dig into and get hung up on the particulate matter on the surface, making it difficult to slide the vacuum cleaner head easily across the surface.

To increase further the ease of sliding of the head across the surface, the counteracting vacuum and fluid jetting forces can be adjusted relative to each other such that the resultant force imparts a slightly floating effect on the vacuum head.

Setting an initial adjustment between glide shoe 28 and vacuum nozzle 10, and maintaining the desired relationship between these parts as the glide shoe wears, is easily accomplished by loosening bolts 34 and raising or lowering vacuum nozzle 10 within the limits permitted by slots 32.

In a similar fashion, fluid conduits 38 and their fluid jet termini 40 are adjustable toward and away from the surface being cleaned by loosening bolts 48 and sliding fluid conduit 42 within the limits permitted by slots 26.

An initial adjustment for fluid jets 40 should be such that the fans of fluid issuing from them overlap slightly to avoid dead spots between the jets. Such dead spots would be translated into a striped pattern on the surface since more partially embedded particulates would be left on the surface in areas where the streams of high velocity fluids did not reach them.

As the fluid jets wear through use, resulting in the spray cones diminishing in diameter, it becomes necessary to adjust the jets to reestablish an overlapping relationship of spray cones. This adjustment is accomplished by loosening bolts 48 and sliding fluid conduit 42 in slots 26, and retightening bolts 48.

It is also within the capability of the vacuum cleaner head of the present invention, to change the angle of impingement of fluid issuing from jets 40 with respect to the surface to be cleaned. This may be desirable to compensate for spray pattern deflection due to air flow through the vacuum nozzle, or to improve the "cutting" action of the jetted fluid against partially embedded or baked-on particulate materials. This adjustment can be accomplished by loosening bolts 48, applying rotational movement to conduit 42 thereby allowing fluid conduits 38 and their jet termini 40 to move arcuately within the vacuum chamber 18 to the limits permitted by elongated openings 39, and then retightening bolts 48.

In order to move the particulate matter through the vacuum nozzle and into a recovery system, air flow as well as negative pressure are necessary. Openings 22 in illustrated side 16 of vacuum nozzle 10 provide a fixed minimum amount of air flow by establishing communication between the vacuum chamber and ambient atmosphere. However, in certain situations, the loading of particulate matter in the vacuum lines may require higher than normal air velocities to keep the particulate matter moving toward the recovery system. This situation calls for additional openings between the vacuum chamber and ambient atmosphere. When higher than normal air velocities are required, the additional air can be provided by loosening bolt assemblies 60 and sliding plates 56 in slotted openings 58 to expose one or more apertures 54.

As an example of parameter values useful in practicing the present invention, it has been found that in order to remove from the roof pea gravel ranging in size from ¼ inch to ⅜ inch, using water as the fluid, approximately 1.5 gallons per minute of water per fluid jet is consumed at pump pressures within the range of 4,000–6,000 psi. This rate of water will dislodge and fluidize substantially all particulate matter other than that firmly embedded in the waterproofed membrane. In order to lift the particulate matter off the roof together with substantially all of the water, requires a movement of air at the rate of about 1,400 to 1,500 cubic feet per minute with a pressure at the vacuum pump of about 15–16 inches of mercury.

Somewhat higher water pressures, air velocities and are required to remove larger particulate matter in the form of rocks ranging in size from ½ inch to ⅝ inches.

Having thus described my invention, I claim:

1. A hand-held, slidable vacuum cleaner head useful for removing loose and partially embedded gravel and similar particulates from roofs and other surfaces comprising:

an elongated vacuum nozzle having a top, sides and an open bottom defining a vacuum chamber, means providing communication between said vacuum chamber and a source of vacuum, support means for said nozzle comprising means disposed peripherally of and circumscribing the open bottom thereof, means for adjusting the height of said nozzle with respect to said support means, means for injecting fluid under pressure into said vacuum chamber comprising a plurality of fluid conduits spaced longitudinally of said nozzle, said top having a plurality of openings and said conduits extending through said openings in the top thereof into said vacuum chamber, each such conduit terminating in a fluid jet, means for adjustably moving said fluid conduits through said openings for adjusting their fluid jet termini toward and away from the open bottom of said nozzle and the surface being cleaned, and means for connecting said fluid conduits with a source of fluid under pressure.

2. The vacuum cleaner head defined in claim 1 further comprising adjustable means providing communication between said vacuum chamber and ambient atmosphere.

3. The vacuum cleaner head defined in claim 2 wherein said adjustable means comprises at least one aperture formed in the top of said elongated vacuum nozzle, and imperforate means fixedly slidable from a first position, where said aperture is substantially covered, to a second position where said aperture is substantially exposed.

4. The vacuum cleaner head defined in claim 1 wherein the lower edge of one of the elongated sides of the vacuum nozzle has a plurality of fixed openings providing communication between the vacuum chamber and ambient atmosphere.

5. A hand-held, slidable vacuum cleaner head useful for removing loose and partially embedded gravel and similar particulates from roofs and other surfaces comprising:

an elongated vacuum nozzle having a top, sides and an open bottom defining a vacuum chamber, means providing communication between said vacuum chamber and a source of vacuum, support means for said nozzle comprising a planar member disposed peripherally of and circumscribing the open bottom thereof and being adapted to contact and glide over the surface to be vacuum cleaned, an elongated opening in said planar member of slightly larger dimensions than said nozzle, upstanding bracket means disposed along the inner periphery of said elongated opening, and fastener means securing the ends of said elongated nozzle to said upstanding bracket means, means for adjusting the height of said nozzle with respect to said support means, means for injecting fluid under pressure into said vacuum chamber comprising a plurality of fluid conduits spaced longitudinally of said nozzle and extending through the top thereof into said vacuum chamber, each such conduit terminating in a fluid jet, means for moving said fluid conduits and their fluid jet termini toward and away from the open bottom of said nozzle, and means for connecting said fluid conduits with a source of fluid under pressure.

6. The vacuum cleaner head defined in claim 5 wherein said fastener means is a bolt assembly extending through said upstanding bracket means and the end of said elongated nozzle, and said means for adjusting the height of said nozzle with respect to said support means is a slotted aperture in said upstanding bracket means adapted to receive said bolt assembly.

7. A hand-held, slidable vacuum cleaner head useful for removing loose and partially embedded gravel and similar particulates from roofs and other surfaces comprising:

an elongated vacuum nozzle having a top, sides and an open bottom defining a vacuum chamber, means providing communication between said vacuum chamber and a source of vacuum, support means for said nozzle comprising means disposed peripherally of and circumscribing the open bottom thereof, means for adjusting the height of said nozzle with respect to said support means, means for injecting fluid under pressure into said vacuum chamber comprising a plurality of fluid conduits spaced longitudinally of said nozzle and extending through the top thereof into said vacuum chamber, each such conduit terminating in a fluid jet, means for moving said fluid conduits and their fluid jet termini toward and away from the open bottom of said nozzle comprising a pair of arms each having a lower end secured to an end of the nozzle, and a slotted aperture spaced from said lower end, conduit support means extending between said arms, fastening means adjustably securing the ends of said conduit support means to said slotted apertures, and means securing said fluid conduits for conjoint movement with said conduit support means, and means for connecting said fluid conduits with a source of fluid under pressure.

8. The vacuum cleaner head defined in claim 7 wherein said conduit support means provides fluid communication between said fluid conduits and a source of fluid under pressure.

9. A hand-held, slidable vacuum cleaner head useful for removing loose and partially embedded gravel and similar particulates from roofs and other surfaces comprising:

an elongated vacuum nozzle having a top, sides and an open bottom defining a vacuum chamber, means providing communication between said vacuum chamber and a source of vacuum, support means for said nozzle comprising means disposed peripherally of and circumscribing the open bottom thereof, means for adjusting the height of said nozzle with respect to said support means, means for injecting fluid under pressure into said vacuum chamber comprising a plurality of fluid conduits spaced longitudinally of said nozzle and extending through the top thereof into said vacuum chamber, each such conduit terminating in a fluid jet, means for moving said fluid conduits and their fluid jet termini toward and away from the open bottom of said nozzle, means for adjusting the angle of impingement of fluid issuing from said fluid jets with respect to the surface being cleaned, and means for connecting said fluid conduits with a source of fluid under pressure.

10. The vacuum cleaner head defined in claim 1 further comprising means for protecting the pattern of fluid issuing from said fluid jets against deflection due to the force of air passing into said nozzle.

11. A hand-held, slidable vacuum cleaner head useful for removing loose and partially embedded gravel and similar particulates from roofs and other surfaces comprising:

an elongated vacuum nozzle having a top, sides and an open bottom defining a vacuum chamber, means providing communication between said vacuum chamber and a source of vacuum, support means for said nozzle comprising means disposed peripherally of and circumscribing the open bottom thereof, means for adjusting the height of said nozzle with respect to said support means, means for injecting liquid under pressure into said vacuum chamber comprising a plurality of conduits spaced longitudinally within said nozzle, each such conduit terminating in a jet, means for adjustably moving said liquid conduits for adjusting the angle with which jets direct fluid toward the surface being cleaned, and means for connecting said conduits with a source of fluid under pressure.

* * * * *